US006334798B1

(12) United States Patent
Ushijima et al.

(10) Patent No.: US 6,334,798 B1
(45) Date of Patent: Jan. 1, 2002

(54) METHOD OF AND STRUCTURE FOR CONNECTING ELECTRIC WIRE AND CONNECTING TERMINAL

(75) Inventors: Hitoshi Ushijima; Yasuyuki Saito, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/544,629

(22) Filed: Apr. 6, 2000

(30) Foreign Application Priority Data

Apr. 15, 1999 (JP) ..... 11-108231

(51) Int. Cl.[7] ..... H01R 4/10
(52) U.S. Cl. ..... 439/879; 439/877; 439/203
(58) Field of Search ..... 439/876–879, 439/882, 886, 887, 874, 387, 203

(56) References Cited

U.S. PATENT DOCUMENTS

| | | | | |
|---|---|---|---|---|
| 2,815,497 A | * | 12/1957 | Redslob | 439/203 |
| 2,901,722 A | * | 8/1959 | Arnott, Jr. | 439/203 |
| 3,364,460 A | * | 1/1968 | Bergan | 439/882 |
| 3,895,851 A | * | 7/1975 | Bolton et al. | 439/387 |
| 5,110,387 A | * | 5/1992 | Jasinski et al. | 156/222 |
| 5,672,846 A | * | 9/1997 | Debbault | 174/84 R |
| 5,749,756 A | * | 5/1998 | Vockroth et al. | 439/879 |

FOREIGN PATENT DOCUMENTS

| | | | |
|---|---|---|---|
| EP | 0 054 854 A2 | 6/1982 | H01R/4/18 |
| EP | 0 261 905 A2 | 3/1988 | H01R/9/07 |
| EP | 0 668 628 A2 | 8/1995 | H01R/4/18 |
| GB | 302432 | 12/1928 | |
| GB | 374198 | 6/1932 | |
| GB | 2 340 674 A | 2/2000 | H01R/4/02 |

* cited by examiner

*Primary Examiner*—Brian Sircus
*Assistant Examiner*—Son Nguyen
(74) *Attorney, Agent, or Firm*—Sughrue Mion, PLLC

(57) ABSTRACT

In a structure 21 for connecting an electric wire and a connecting terminal in the invention, a ductile metal film 29 is formed in advance on an inner surface of a conductor caulking portion 24 of a crimp terminal 22 by such as plating, vacuum deposition, or adhesion. Then, the conductor caulking portion 24 in the rear portion of the crimp terminal 22 is caulked onto core wire portions M in a state of being stripped and extended in the axial direction from an end of a sheathed wire W to thereby establish connection. Subsequently, the metal film 29 is fused on heating. Accordingly, the ductile metal film 29 enters gaps between the inner surface of the conductor caulking portion 24 and the core wire portions M and between adjacent ones of the core wire portions M by the caulking stress. Hence, the area of contact between the conductor caulking portion 24 and the core wire portions M via the metal film 29 increases, and conductivity improves, thereby making it possible to suppress heat generation.

4 Claims, 9 Drawing Sheets

METHOD OF AND STRUCTURE FOR CONNECTING ELECTRIC WIRE AND CONNECTING TERMINAL

BACKGROUND OF THE INVENTION

1. Technical Field to Which the Invention Belongs

The present invention relates to a method of and a structure for connecting an electric wire and a connecting terminal in which core wire portions of an electric wire are caulked by caulking portions of a connecting terminal so establish electrical connection.

2. Related Art

Various crimp terminals are known in which a conductor portion of an electric wire is caulked by caulking portions of a connecting terminal so establish electrical connection.

As shown in FIG. 11, a tip portion of a sheath portion S of a sheathed wire W is stripped by a predetermined length, and core wire portions M are exposed in an axially extended state. In addition, a connecting terminal 51 is formed by stamping a metal plate. The connecting terminal 51 has in its rear portion a sheath caulking portion 52, a conductor caulking portion 53 and a positioning portion 54 with a pair of positioning grooves 55. The connecting terminal 51 has in its front portion a pin-shaped contact portion 56 which electrically contacts a mating female terminal.

To connect the sheathed wire W to the connecting terminal 51, after the sheath portion S of the sheathed wire W is placed on the sheath caulking portion 52, and the core wire portions M are placed on the conductor caulking portion 53, both caulking portions 52 and 53 are caulked by an unillustrated automatic terminal crimping apparatus, as shown in FIG. 12. As for the conductor caulking portion 53 in this state, the core wire portions M are merely caulked by the conductor caulking portion 53 as shown in FIG. 13, the mutual contact is mere contact at a plurality of points, so that there has been a problem in that heat is generated if a large current flows.

Accordingly, it is the general practice to solder the caulked conductor caulking portion 53 and the core wire portions M. Consequently, since the solder is present between the core wire portions M and the conductor caulking portion 53, the area of electrical contact becomes large, and heat is made difficult to generate, so that a highly reliable connecting structure can be obtained.

In addition, since it is possible to prevent the formation of oxide films on the core wire portions M and the inner surface of the conductor caulking portion 53, it is possible to maintain stable conductivity.

However, with the above-described general structure for connecting an electric wire and a connecting terminal, since flux for solder is necessarily used for soldering. There has been a problem in that the core wire portions of the wire become corroded.

In addition, since the soldering operation is difficult to be incorporated into a continuous automation line in the process for caulking connecting terminals. There is a problem in that productivity is lowered.

SUMMARY OF THE INVENTION

The invention has been devised in view of the above-described problems, and its object is to provide a method of and a structure for connecting an electric wire and a connecting terminal which are capable of maintaining excellent conductivity without corrosion and of coping with a continuous automation line as well.

The above problems concerning the invention can be overcome by a method of connecting an electric wire and a connecting terminal, said electric wire having a core wire portion and a sheath, said core wire portion exposed from an end of said sheath, said connecting terminal having a conductor caulking portion to caulk said core wire portion, said method including the steps of:

applying a metal member to said core wire portion, a ductility of said metal member being higher than that of said core wire portion;

caulking said core wire portion by said conductor caulking portion to contact an inner surface of said conductor caulking portion with said metal member together; and fusing said metal member.

In accordance with the method of connecting an electric wire and a connecting terminal constructed as described above, if the conductor caulking portion of the connecting terminal is caulked onto the wire via a ductile metal, the ductile metal is deformed by the contact portion and enters gaps between adjacent ones of the core wire portions and between the core wire portions and the connecting terminal. Subsequently, by heating and fusing the metal, adjacent ones of the core wire portions as well as the core wire portions and the connecting terminal are joined. Consequently, the area of contact between the core wire portions and the connecting terminal increases, and the formation of oxide films is prevented, so that it is possible to maintain excellent conductivity, thereby making it possible to ensure high reliability. In addition, since soldering is not performed, it is possible to prevent corrosion attributable to flux and easily incorporate the connecting method of the invention into a continuous automation line, thereby making it possible to enhance productivity.

In addition, the above problems concerning the invention can be overcome by a method of connecting an electric wire and a connecting terminal, said electric wire having a core wire portion and a sheathed wire, said core wire portion exposed from an end of said sheathed wire, said connecting terminal having a conductor caulking portion to caulk said core wire portion, said method including the step of:

caulking said core wire portion by said conductor caulking portion to contact of an inner surface of said conductor caulking portion with said core wire portion;

applying a liquefied resin between said inner surface and said core wire portion; and curing said liquefied resin.

In addition, as the liquefied resin, it is possible to cite a phenolic resin, an instantaneous adhesive agent, or the like, but the liquefied resin is not particularly limited.

The above problems concerning the invention can be overcome by a structure for connecting an electric wire and a connecting terminal including:

said electric wire having a core wire portion and a sheathed wire, said core wire portion defined by exposing an end of said sheathed wire, said connecting terminal having a conductor caulking portion to caulk said core wire portion, said core wire portion extending to an axial direction from said an end portion of said sheathed wire; and a metal member provided between said core wire portion and an inner surface of said conductive caulking portion, a ductility of said metal member being higher than that of said core wire portion.

In accordance with the structure for connecting an electric wire and a connecting terminal constructed as described above, since the conductor caulking portion of the connecting terminal is caulked onto the core wire portions of the wire via a tubular member or a tape-like member formed of a ductile metal, the ductile metal is deformed by the contact portion and enters the gaps between adjacent ones of the core wire portions and between the core wire portions and the connecting terminal. subsequently, by heating and fusing this tubular member or tape-like member, the core wire portions and the conductor caulking portion of the connecting terminal are joined. Consequently, the area of contact between the core wire portions and the connecting terminal increases, and the formation of oxide films attributable to flux is prevented, so that it is possible to maintain excellent conductivity, thereby making it possible to ensure high reliability.

In addition, since the ductile metal is a tubular member or tape-like member, a general connecting terminal can be used as it is, and the incorporation into a continuous automation line is facilitated. Accordingly, it is possible to easily improve the conductivity of general connecting terminals and to easily enhance the reliability of the connecting terminals, and it is possible to improve productivity.

In addition, the tubular member or the tape-like member is fused by any one of a spot heater, a soldering iron, ultrasonic welding, and a laser.

The above problems concerning the invention can be overcome by a structure for connecting an electric wire and a connecting terminal comprising:

said electric wire having a core wire portion and a sheath, said core wire portion exposed from an end of said sheath, said core wire portion extending in an axial direction from said end of said sheath;

said connecting terminal having a conductor caulking portion to caulk said core wire portion;

a metal film formed at an inner surface of said conductor caulking portion, a ductility of said metal film being higher than that of said core wire portion;

wherein said core wire portion is caulked by said conductor caulking portion to contact said metal film with aid metal member.

In accordance with the structure for connecting an electric wire and a connecting terminal constructed as described above, if the conductor caulking portion of the connecting terminal is caulked onto the wire via a metal whose ductility is higher than that of the core wire portions, the ductile metal is deformed by the contact portion and enters the gaps between adjacent ones of the core wire portions or between the core wire portions and the connecting terminal. Consequently, the area of contact between the core wire portions and the connecting terminal increases, and the formation of oxide films is prevented, so that it is possible to maintain excellent conductivity, thereby making it possible to ensure high reliability. In addition, since it is possible to immediately proceed to the caulking operation, productivity can be improved.

In addition, in the above-described structure for connecting an electric wire and a connecting terminal, the metal film is preferably formed on the inner surface of the conductor caulking portion by plating or vacuum deposition. Further, in the above-described structure for connecting an electric wire and a connecting terminal, the metal film is preferably formed by causing a ductile film to adhere to the inner surface of the conductor caulking portion by plating.

In accordance with the structure for connecting an electric wire and a connecting terminal constructed as described above, since the ductile metal is formed on the inner surface of the conductor caulking portion by plating, vacuum deposition, or adhesion, it is possible to immediately proceed to the caulking operation, thereby making it possible to improve productivity further.

The aforementioned ductility if a kind of plasticity including ductility or malleability, and refers to a property in which a metal is drawn without being fractured or is spread in the form of a foil by a stress exceeding a limit of elasticity, such as pressure and impact.

In addition, the aforementioned ductile metal is, for instance, gold, silver, lead, zinc, aluminum or the like, and is a soft metal whose ductility is higher than that of at least the caulking portion of the connecting terminal.

In addition, the ductile metal in terms of its form is preferably a tubular ring or a tape-like film which is separate from the connecting terminal, or a metal film formed on the inner surface of the conductor caulking portion of the connecting terminal, but the form of the ductile metal is not particularly limited.

DETAILED DESCRIPTION OF PREFERRED EMBODIMENT

Figure 1:
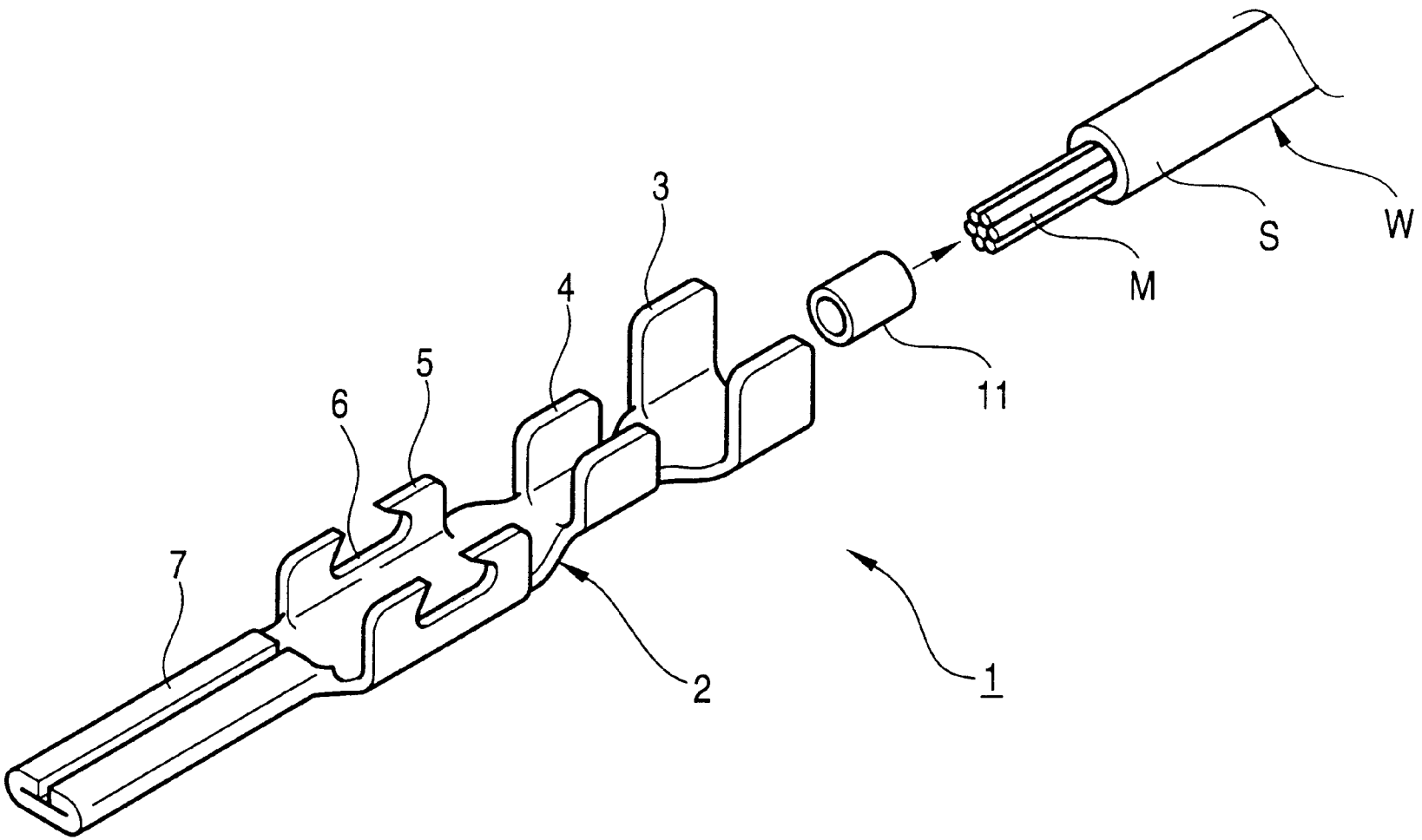
FIG. 1 is an exploded perspective view illustrating a first embodiment of a structure for connecting an electric wire and a connecting terminal in accordance with the invention.
Figure 2:
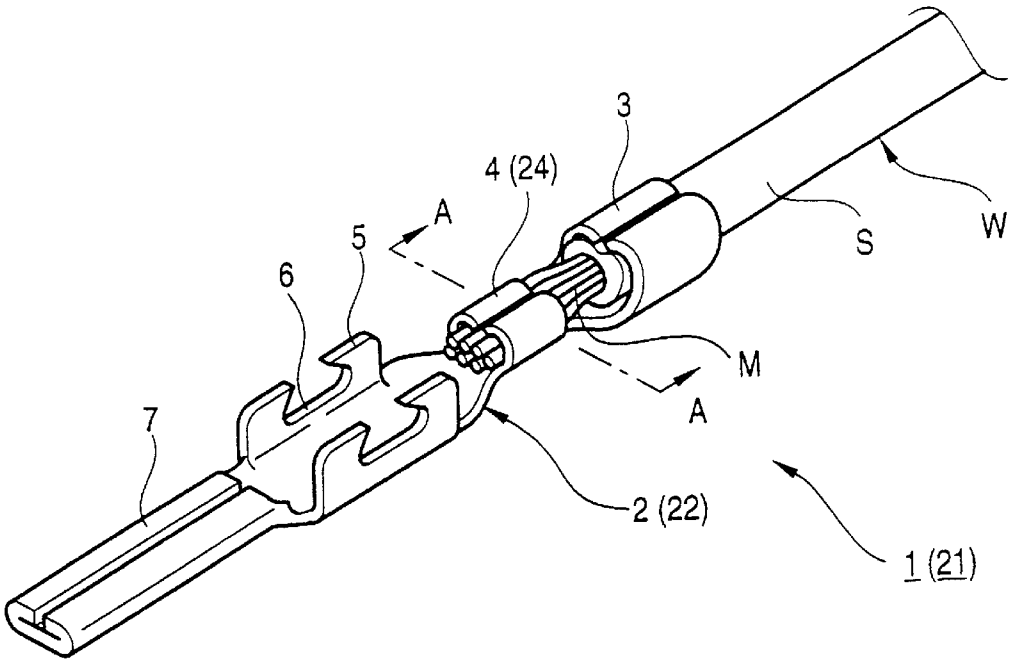
FIG. 2 is a perspective view illustrating a state of completion of the assembly in FIGS. 1 and 5.
Figure 3:
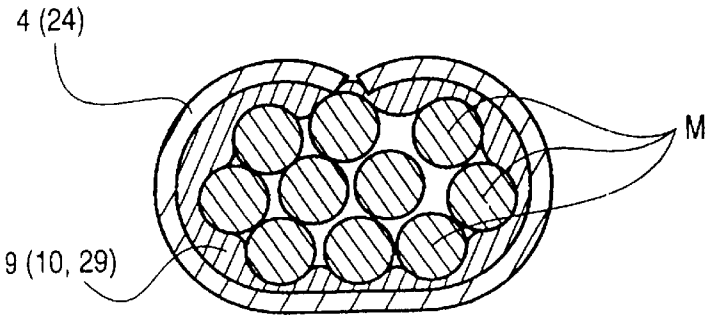
FIG. 3 is a cross-sectional view taken along line A—A in FIG. 2.
Figure 4:
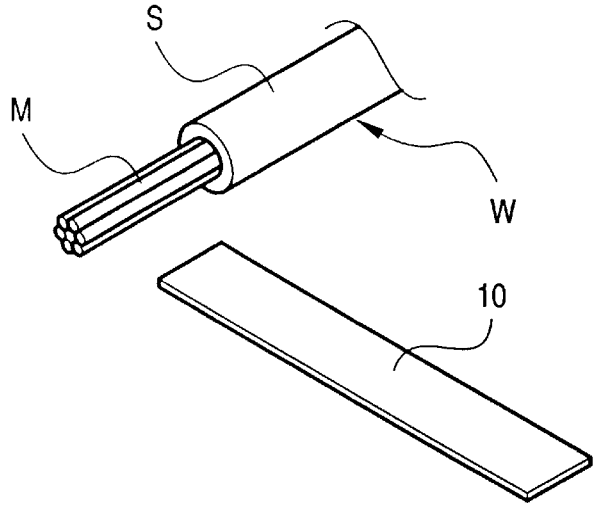
FIG. 4 is a partial perspective view illustrating a modification in FIG. 1.
Figure 5:
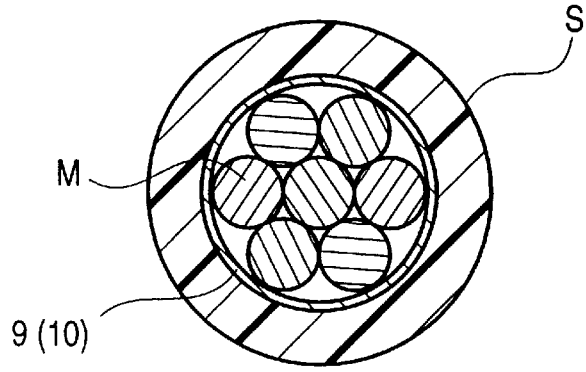
FIG. 5 is a cross-sectional view illustrating a method of winding in FIG. 4.
Figure 6:
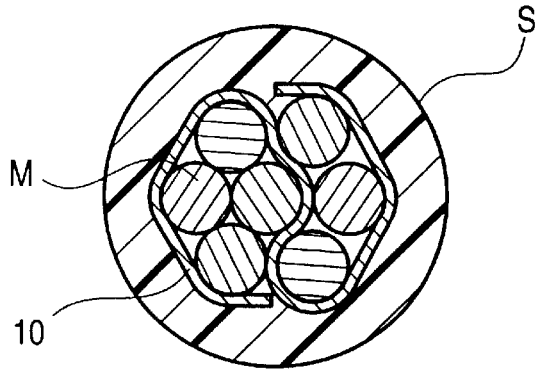
FIG. 6 is a cross-sectional view illustrating a modification in FIG. 5.
Figure 7:
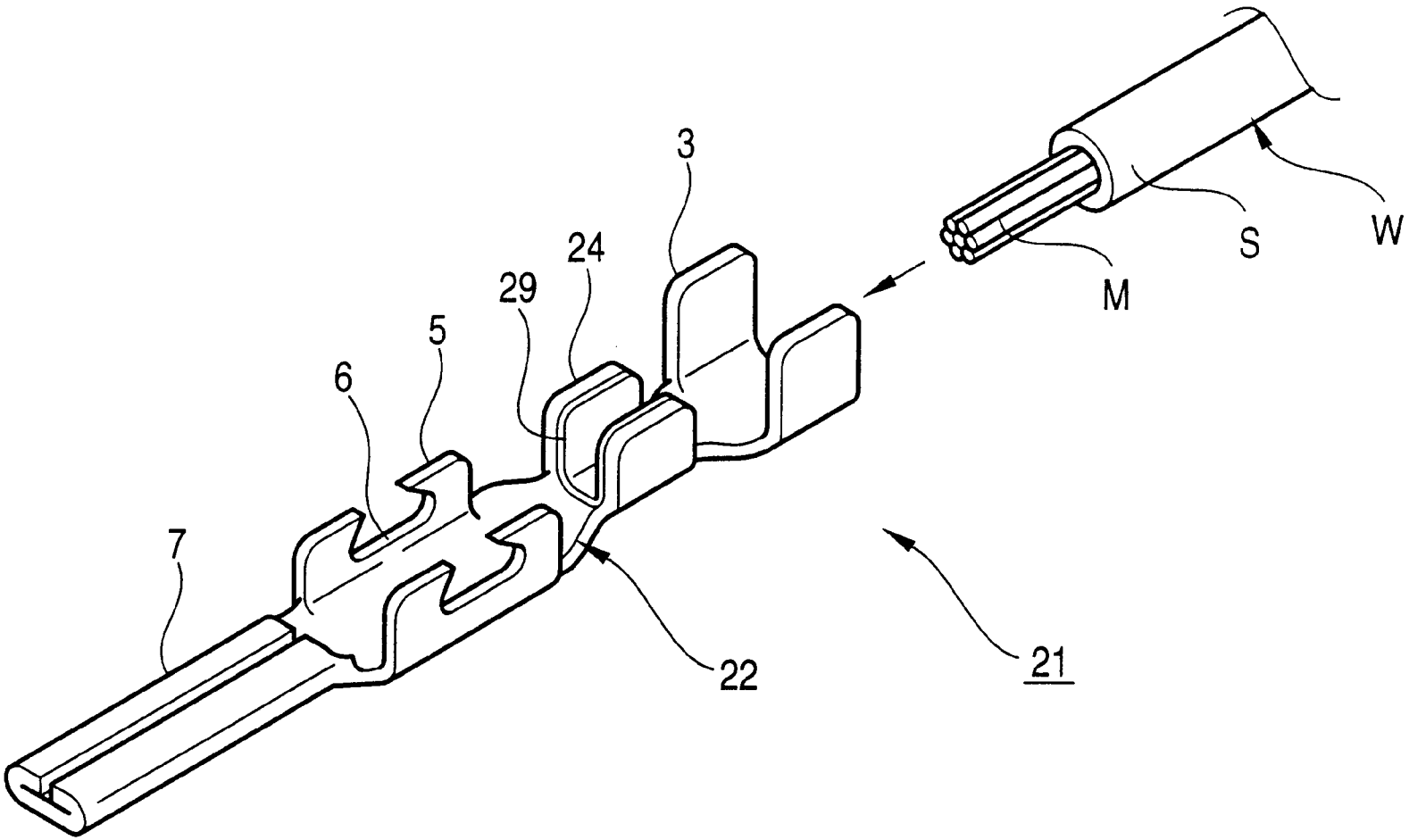
FIG. 7 is an exploded perspective view illustrating a second embodiment of the structure for connecting an electric wire and a connecting terminal in accordance with the invention.
Figure 8:
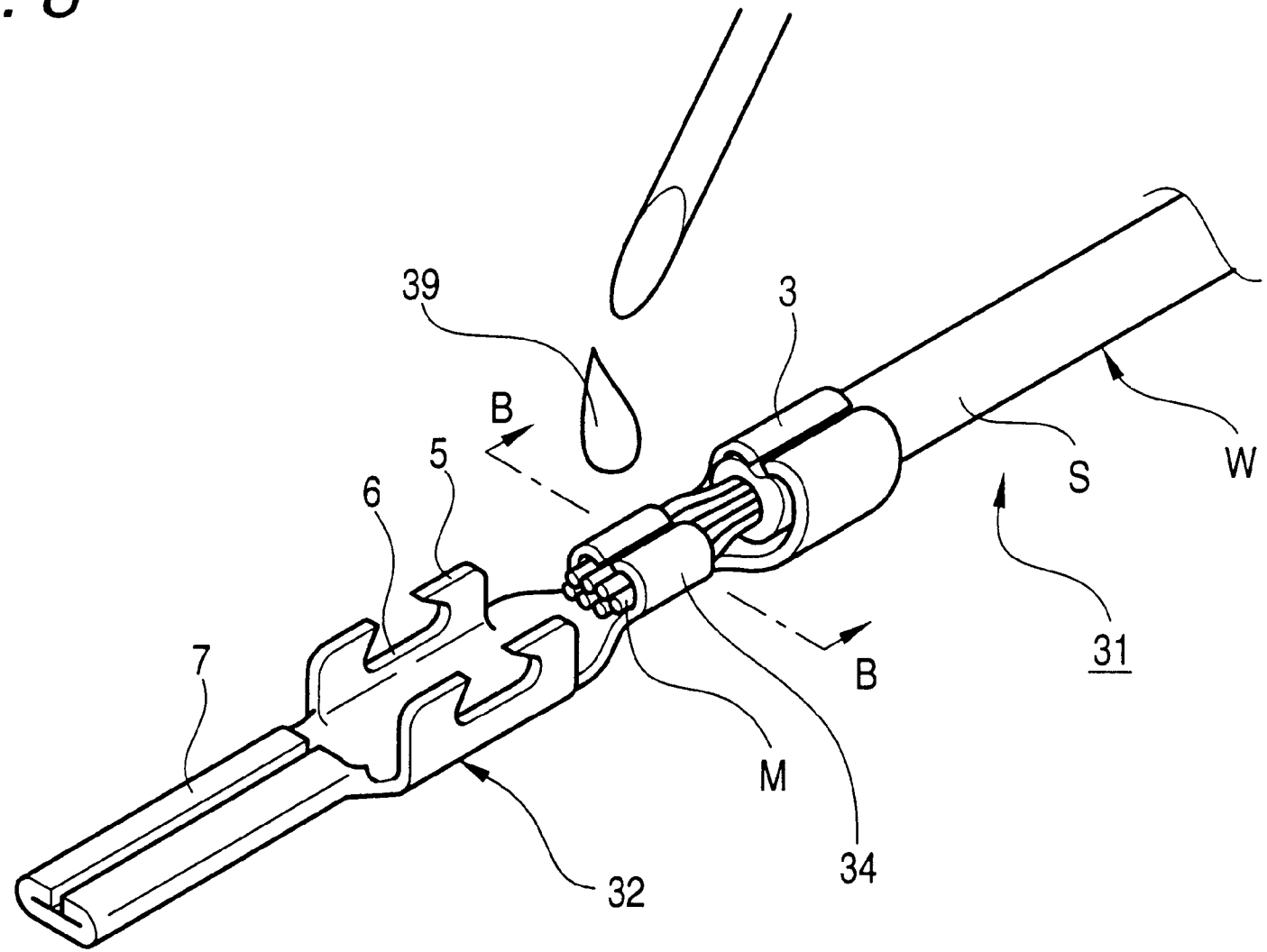
FIG. 8 is an exploded perspective view illustrating a third embodiment of the structure for connecting an electric wire and a connecting terminal in accordance with the invention.
Figure 9:
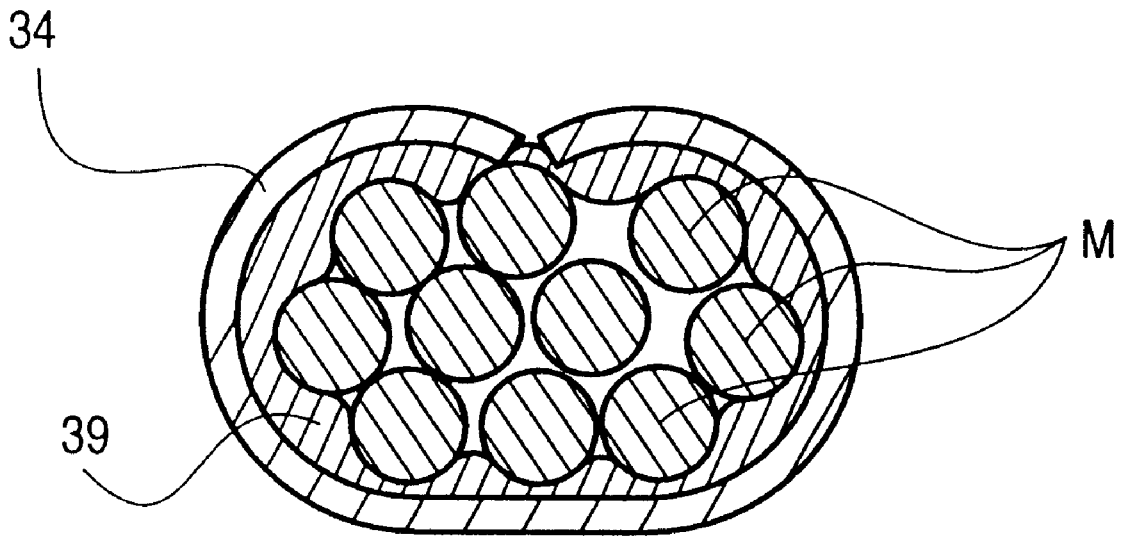
FIG. 9 is a cross-sectional view taken along line B—B in FIG. 8.
Figure 10:
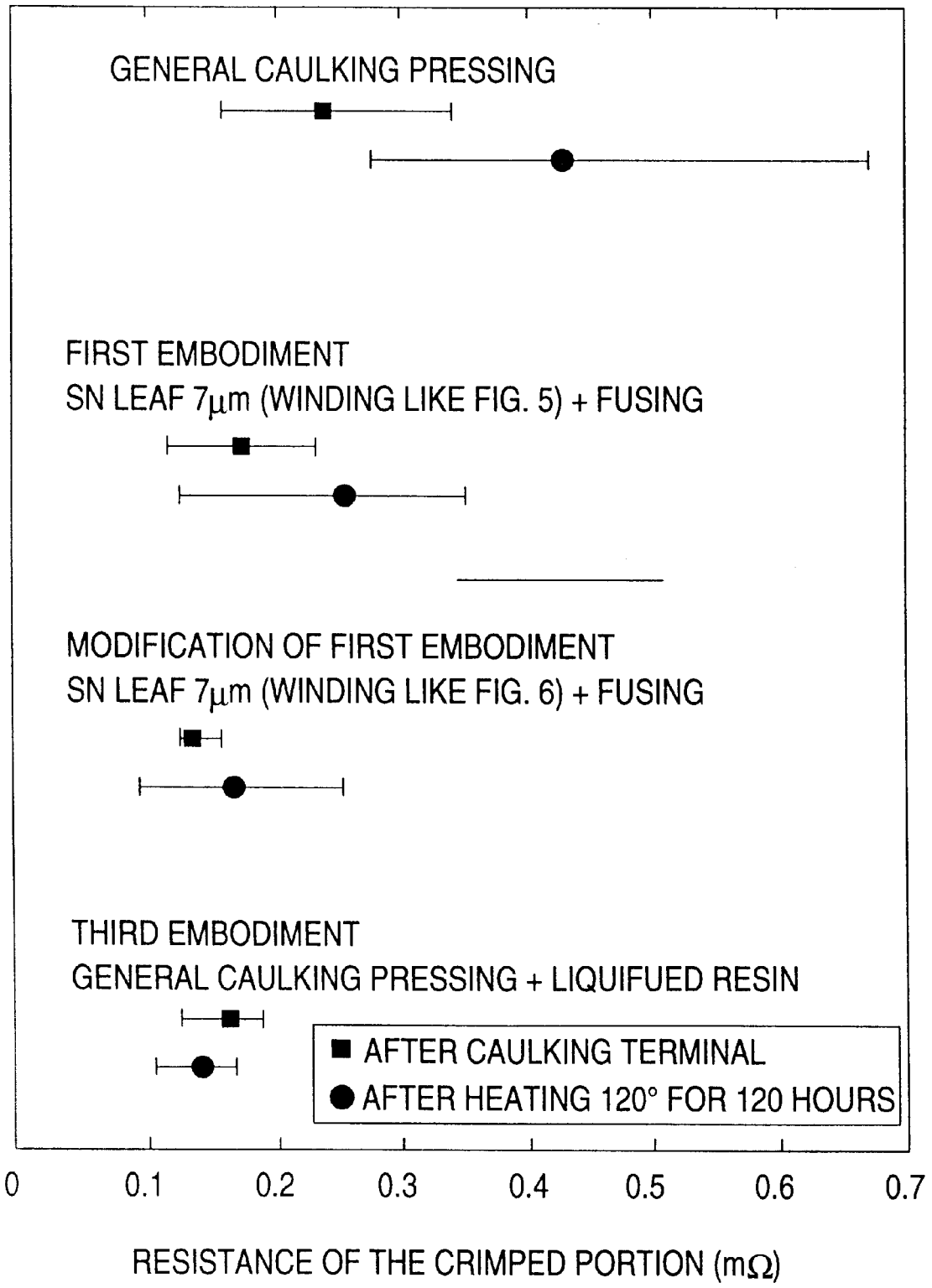
FIG. 10 is a table illustrating test results in the various embodiments of the invention.
Figure 11:
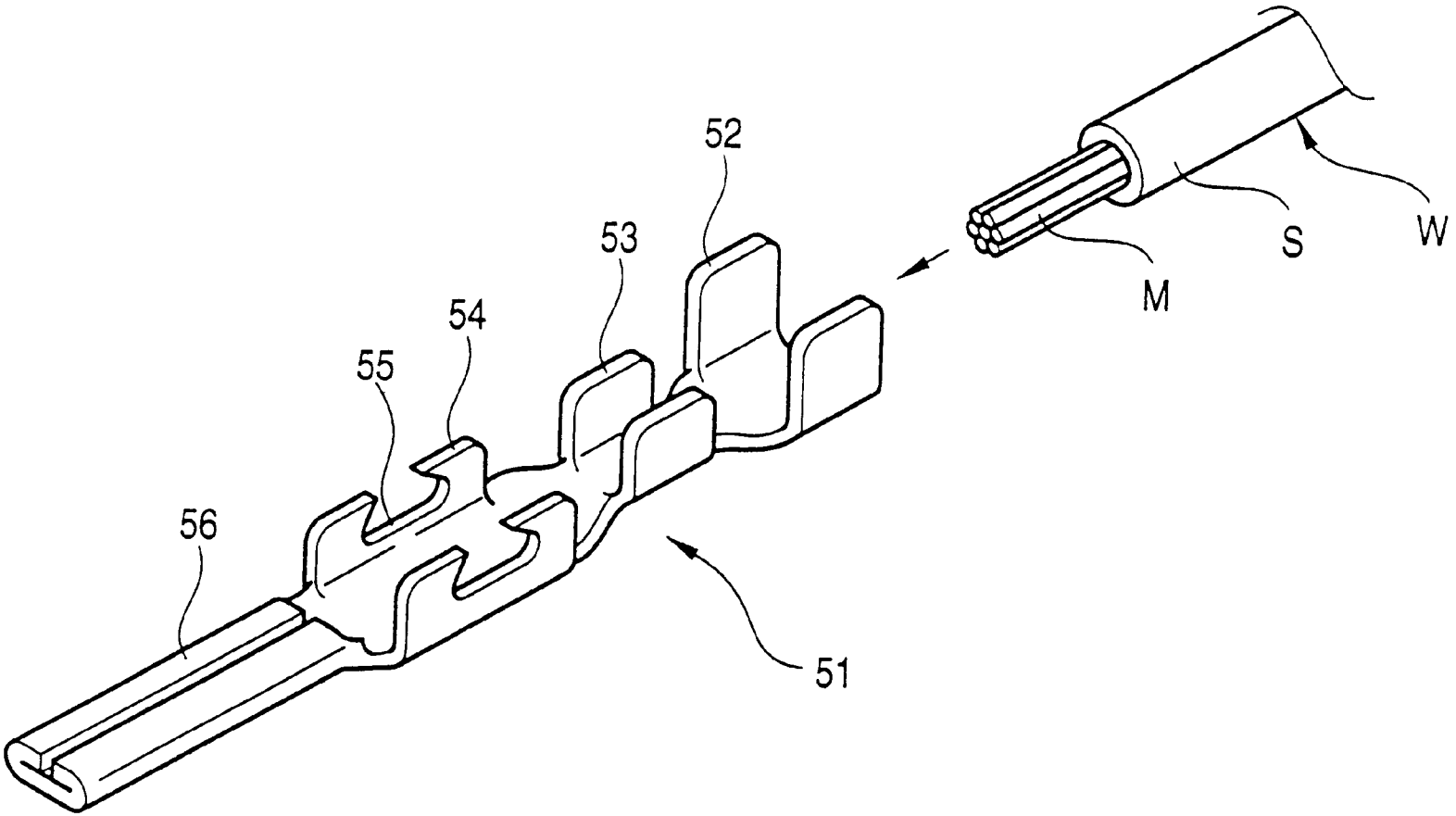
FIG. 11 (PRIOR ART)
FIG. 11 is an exploded perspective view illustrating an example of a general structure for connecting an electric wire and a connecting terminal.
Figure 12:
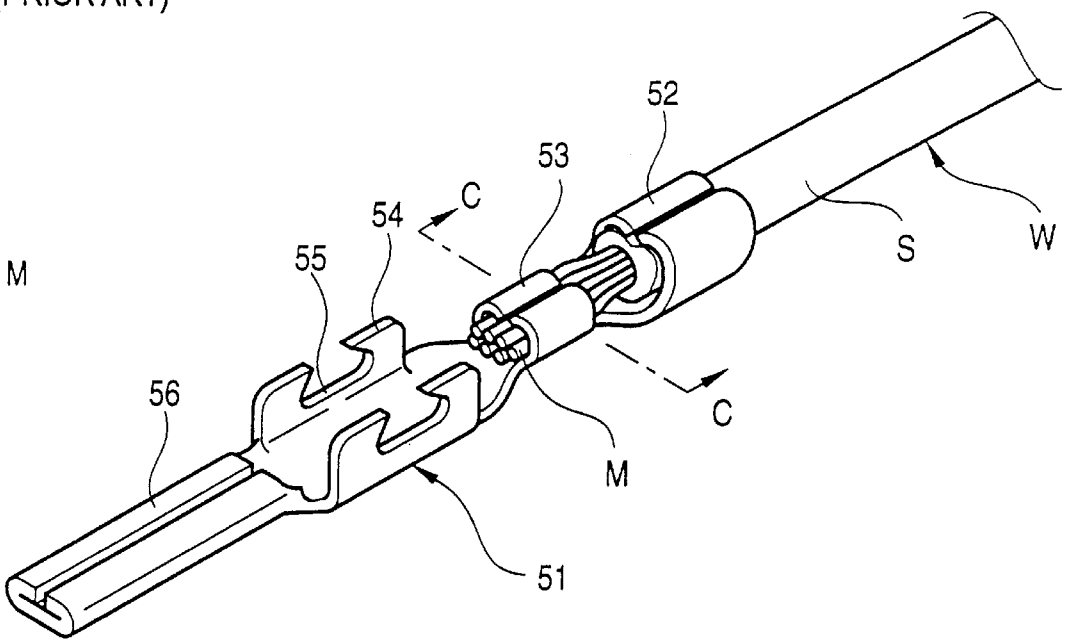
FIG. 12 (PRIOR ART)
FIG. 12 is a perspective view illustrating a state of completion of the assembly in FIG. 11.
Figure 13:
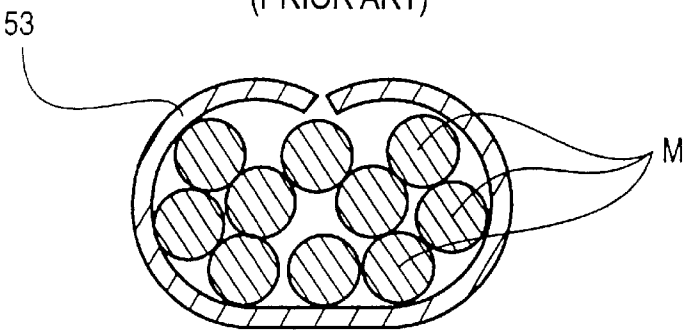
FIG. 13 (PRIOR ART)
FIG. 13 is a cross-sectional view taken along line C—C in FIG. 11.

Referring to FIGS. 1 to 10, a detailed description will be given of the embodiments of the invention. FIG. 1 is an exploded perspective view illustrating a first embodiment of a structure for connecting an electric wire and a connecting terminal in accordance with the invention. FIG. 2 is a perspective view illustrating an assembled state in FIG. 1. FIG. 3 is a cross-sectional view taken along line A—A in FIG. 2. FIG. 4 is a partial perspective view illustrating a modification of the first embodiment in FIG. 1. FIG. 5 is a cross-sectional view after winding in FIG. 4. FIG. 6 is a cross-sectional view illustrating a modification of a winding method in FIG. 5. FIG. 7 is an exploded perspective view illustrating a second embodiment of the structure for connecting an electric wire and a connecting terminal in accordance with the invention. FIG. 8 is an exploded perspective view illustrating a third embodiment of the structure for connecting an electric wire and a connecting terminal in accordance with the invention. FIG. 9 is a cross-sectional view taken along line B—B in FIG. 8. FIG. 10 shows the results of a test on the resistance of a crimped portion in a heating test after terminal caulking processing in accordance with the invention.

As shown in FIG. 1, a structure 1 for connecting an electric wire and a connecting terminal in accordance with a first embodiment of the invention is a structure for caulking a crimp terminal in which core wire portions M exposed by stripping off an end portion of a sheathed wire W by a predetermined length, the core wire portion M are caulked by a conductor caulking portion 4 in the rear of a crimp terminal 2 and is connected. A tubular ring 9 is formed of a ductile metal, i.e., a soft metal having higher ductility than the material of the crimp terminal 2, e.g., gold, silver, lead, zinc, aluminum or the like. The tubular ring is interposed between an inner surface of the conductor caulking portion 4 and the core wire portions M in a state of being extended in the axial direction from the center of an end of the sheathed wire W.

More specifically, the core wire portions M are general a bundle of a plurality of slender copper wires, and the crimp terminal 2 is formed by press working by stamping out a predetermined shape from a metal plate such as abrass plate. The crimp terminal 2 has in its rear portion a sheath caulking portion 3 for caulking a sheath portion S of the wire and the conductor caulking portion 4 for caulking the stripped core wire portions M. In addition, the crimp terminal 2 has in its front portion a positioning portion 5 with a pair of positioning grooves 6 and a pin-shaped contact portion 7 which is electrically connected to a mating terminal.

In the structure 1 for connecting an electric wire and a connecting terminal arranged as described above, the tubular ring 9 is first fitted over the core wire portions M in the state of being extended in the axial direction from the center of the end of the sheathed wire W. Then, after the sheath portion S of the sheathed wire W is placed on the sheath caulking portion 3, and the core wire portions M are placed on the conductor caulking portion 4, both caulking portions 3 and 4 are caulked by an unillustrated automatic terminal crimping apparatus, as shown in FIG. 2.

The characteristic of the structure for connecting an electric wire and a connecting terminal in this embodiment lies in that, if the core wire portions M are caulked by the conductor caulking portion 4 as shown in FIG. 3, the ductile metal tubular ring 9 is squash and enters the gaps between the inner surface of the conductor caulking portion 4 and the core wire portions M and between adjacent ones of the core wire portions M by the caulking stress. The core wire portions M and the conductor caulking portion 4 are subsequently joined upon being fused on heating. Consequently, since the area of contact between the conductor caulking portion 4 and the core wire portions M via the tubular ring 9 increases, conductivity improves, so that heat generation can be suppressed, thereby making it possible to obtain a highly reliable crimp terminal.

In addition, since the general used solder is not used, it is possible to prevent the formation of oxide films due to flux, and the incorporation into a continuous automation line can be facilitated, thereby making it possible to attain high reliability and improve productivity.

In addition, since the general crimp terminal can be used as it is, it is possible to easily improve the conductivity of the general crimp terminal, and it is possible to easily manufacture a highly reliable crimp terminal at low cost.

Next, as shown in FIG. 4, as a modification of the above-described first embodiment, it is possible to form an arrangement similar to that of the tubular ring by winding tape-like film 10 instead of the tubular ring 9. Accordingly, after the winding of the tape-like film 10 shown in FIGS. 5 and 6, the sheath portion S of the sheathed wire W is placed on the sheath caulking portion 3, the core wire portions M are placed on the conductor caulking portion 4, and both caulking portions 3 and 4 are caulked, thereby making it possible to obtain a caulked structure identical to the one shown in FIGS. 2 and 3.

Next, referring to FIGS. 3 and 7, a description will be given of a structure 21 for connecting an electric wire and a connecting terminal in accordance with a second embodiment of the invention. This embodiment differs from the above-described first embodiment in that, instead of fitting the tubular ring 9 or the tape-like film 10 over the core wire portions M, a ductile metal film 29 is formed on the inner surface of a conductor caulking portion 24 of a crimp terminal 22 by means of such as plating, vapor deposition, and adhesion. It should be noted that the metal film 29 is formed of a soft metal having higher ductility than the material of the crimp terminal 22, e.g., gold, silver, lead, zinc, aluminum or the like, and that portions having the same arrangements as those of the above-described first embodiment will be denoted by the same reference numerals, and a detailed description thereof will be omitted, reference being had to FIGS. 2 and 3.

In the structure 21 for connecting an electric wire and a connecting terminal in this embodiment having the above-described construction, the ductile metal film 29 is formed on the inner surface of the conductor caulking portion 24 of the crimp terminal 22 by such as plating, vapor deposition, and adhesion before or after stamping or after press working. Subsequently, the sheath portion S of the sheathed wire W is placed on the sheath caulking portion 3, the core wire portions M are placed on the conductor caulking portion 24, and both caulking portions 3 and 24 are caulked by the unillustrated automatic terminal crimping apparatus.

Then, as shown in FIG. 3, the ductile metal film 29 in this embodiment is squashed and enters the gaps between the inner surface of the conductor caulking portion 24 and the core wire portions M and between adjacent ones of the core wire portions M by the caulking stress. Consequently, since the area of contact between the conductor caulking portion 24 and the core wire portions M via the metal film 29 increases, conductivity improves, so that heat generation can be suppressed, thereby making it possible to obtain a highly reliable crimp terminal.

In addition, the metal film 29 is fused on heating after caulking in the same way as in the above-described first embodiment, thereby making it possible to obtain higher reliability.

In addition, since the generally used solder is not used as in the first embodiment, it is possible to prevent the formation of oxide films due to flux, and the incorporation into an automation line can be facilitated, thereby making it possible to attain high reliability and improve productivity.

In addition, since the general crimp terminal can be used as it is, it is possible to easily improve the conductivity of the general crimp terminal, and it is possible to easily manufacture a highly reliable crimp terminal at low cost.

Further, in this embodiment, since the metal film 29 is formed on the inner surface of the conductor caulking portion 24 by such as plating, vapor deposition, and adhesion, it is possible to immediately proceed to the caulking operation, so that the incorporation into the continuous automation line can be further facilitated. Accordingly, it is possible to further improve the productivity of a highly reliable crimp terminal.

Next, referring to FIGS. 8 and 9, a description will be given of a structure 31 for connecting an electric wire and a connecting terminal in accordance with a third embodiment of the invention. In this embodiment, after the sheath portion S of the sheathed wire W is placed on the sheath caulking portion 3, and the core wire portions M are placed on a conductor caulking portion 34, both caulking portions 3 and 34 are caulked by the unillustrated automatic terminal crimping apparatus. Subsequently, a liquefied resin 39 is applied to the conductor caulking portion 34, and is allowed to dry at room temperature or to cure on heating. It should be noted that portions having the same arrangements as those of the above-described first embodiment will be denoted by the same reference numerals, and a detailed description thereof will be omitted, reference being had to FIGS. 2 and 3.

As shown in FIG. 9, the liquefied resin 39 in this embodiment permeates and enters the gaps between the inner surface of the conductor caulking portion 34 and the core wire portions M and between adjacent ones of the core wire portions M. Subsequently, since the liquefied resin 39 is dried at room temperature or cured on heating, the formation of oxide films is prevented, so that it is possible to maintain excellent conductivity and ensure high reliability.

In addition, since the generally used solder is not used as in the first embodiment, it is possible to prevent the formation of oxide films due to flux, and the incorporation into an automation line can be facilitated, thereby making it possible to attain high reliability and improve productivity.

In addition, since the general crimp terminal can be used as it is, it is possible to easily improve the conductivity of the general crimp terminal, and it is possible to easily manufacture a highly reliable crimp terminal at low cost.

In addition, as shown in FIG. 10, when a heating test at 120° C. for 120 hours was conducted, in all the embodiments the resistance of the crimped portion was lower than the general caulking processing.

Further, in the third embodiment, after the heating test the resistance of the crimped portion was even lower. This attributable to the fact that since a phenolic resin was used as the liquefied resin, the resistance of the conductor became small due to the reducing action of formaldehyde.

It should be noted that the invention is not limited to the above-described embodiments, and may be implemented by other embodiments by making appropriate modifications. For example, although both the crimp terminals 2 and 32 in the above-described embodiments were male terminals, the invention is applicable to female terminals as well.

In addition, although a description has been given of the tubular ring 9 in the first embodiment, the tubular ring 9 need not be a ring, and the invention is applicable to a semitubular shape formed by longitudinally splitting a tube along its axial direction.

As described above, in accordance with the method of connecting an electric wire and a connecting terminal according to the invention, after caulking is effected in a state in which a metal whose ductility is higher than that of the core wire portions is interposed between the core wire portions and an inner surface of the conductor caulking portion, the metal is fused on heating, thereby allowing the fused metal to enter the gaps between adjacent ones of the core wire portions and between the core wire portions and the connecting terminal.

Accordingly, the area of contact between the core wire portions and the connecting terminal increases, and the formation of oxide films is prevented, so that it is possible to maintain excellent conductivity, thereby making it possible to ensure high reliability.

In addition, since soldering is not performed, it is possible to prevent corrosion attributable to flux and easily incorporate the connecting method of the invention into a continuous automation line, thereby making it possible to enhance productivity.

In addition, in accordance with the structure for connecting an electric wire and a connecting terminal according to the invention, after the conductor caulking portion is caulked onto the core wire portions, a liquefied resin is applied to the conductor caulking portion, and the liquefied resin is allowed to dry at room temperature or cure on heating. Accordingly, the liquefied resin enters the gaps between adjacent ones of the core wire portions or between the core wire portions and the connecting terminal, and cures after drying, so that it is possible to prevent the entrance of gas such as oxygen.

Hence, since the area of contact between the core wire portions and the connecting terminal increases, and since the formation of oxide films can be prevented, it is possible to maintain excellent conductivity and ensure high reliability.

In accordance with the structure for connecting an electric wire and a connecting terminal, after caulking is effected in a state in which a tubular member or tape-like member formed of a ductile metal is interposed between an inner surface of the conductor caulking portion and the core portions extending axially from the end portion of the sheathed wire, the tubular member or the tape-like member is fused on heating. Therefore, the ductile metal is deformed by the contact portion and enters the gaps between adjacent ones of the core wire portions and between the core wire portions and the connecting terminal. Subsequently, by heating and fusing this tubular member or tape-like member, the core wire portions and the conductor caulking portion of the connecting terminal are joined.

Accordingly, the area of contact between the core wire portions and the connecting terminal increases, and the formation of oxide films attributable to flux is prevented, so that it is possible to maintain excellent conductivity, thereby making it possible to ensure high reliability.

In addition, since a general connecting terminal can be used as it is, and the incorporation into a continuous automation line is facilitated, it is possible to easily enhance the reliability of general connecting terminals and improve productivity further.

In addition, in accordance with the structure for connecting an electric wire and a connecting terminal, a ductile metal film is formed in advance on an inner surface of the conductor caulking portion of the connecting terminal. If the conductor caulking portion is caulked onto the core portions extending axially from the end portion of the sheathed wire, the ductile metal enters the gaps between adjacent ones of the core wire portions or between the core wire portions and the connecting terminal.

Consequently, the area of contact between the core wire portions and the connecting terminal increases, and the formation of oxide films is prevented, so that it is possible to maintain excellent conductivity, thereby making it possible to ensure high reliability. In addition, since it is possible to immediately proceed to the caulking operation, productivity can be improved.

Furthermore, when the metal film is formed on the inner surface of the conductor caulking portion by plating or vacuum deposition or by attaching a ductile film thereto, it is possible to immediately proceed to the caulking operation, so that productivity can be improved further.

What is claimed is:

1. A structure for connecting an electric wire and a connecting terminal comprising:

said electric wire having a core wire portion and a sheath, said core wire portion exposed from an end of said sheath, said core wire portion extending in an axial direction from said end of said sheath;

said connecting terminal having a conductor caulking portion to caulk said core wire portion;

a metal film formed at an inner surface of said conductor caulking portion, a ductility of said metal film being higher than that of said core wire portion;

wherein said core wire portion is caulked by said conductor caulking portion to contact said metal film with said core wire portion.

2. The structure for connecting an electric wire and a connecting terminal according to claim 13, wherein said metal film is formed by any one of plating, vapor deposition and adhesion.

3. A structure for connecting an electric wire and a connecting terminal comprising:

said electric wire having a core wire portion and a sheathed wire, said core wire portion exposed from an end of said sheath, said connecting terminal having a conductor caulking portion to caulk said core wire portion, said core wire portion extending in an axial direction from said an end portion of said sheath; and a metal member provided between said core wire portion and an inner surface of said conductive caulking portion, a ductility of said metal member being higher than that of said core wire portion.

4. The structure for connecting an electric wire and a connecting terminal according to claim 3, wherein said metal member is filled in gaps formed between said core wire portion and said conductive caulking portion when said conductive caulking portion caulks said core wire portion.

* * * * *